US005927881A

United States Patent [19]

Yang

[11] Patent Number: 5,927,881

[45] Date of Patent: Jul. 27, 1999

[54] MULTIPLE-SHAFT PEN KIT

[76] Inventor: Chin-Chen Yang, 1F, No. 3, Lane 530, Min Tsu Rd., Lu Chou, Taipei Hsien, Taiwan

[21] Appl. No.: 08/963,079

[22] Filed: Nov. 3, 1997

[51] Int. Cl.[6] ..... B43K 27/00

[52] U.S. Cl. ..... 401/29; 401/52; 401/31

[58] Field of Search ..... 401/31, 52, 195, 401/29, 33

[56] References Cited

U.S. PATENT DOCUMENTS 3,282,253 11/1966 Ryan et al. ..... 401/31

3,604,816 9/1971 Levoin ..... 401/31

*Primary Examiner*—David J. Walczak

*Attorney, Agent, or Firm*—Rosenberg, Klein & Bilker

[57] ABSTRACT

A type of multiple-shaft pen kit, comprising a link hook joined to the top of each operating knob in the multiple-shaft pen kit. The link hook pulls an operating unit, and its position can be reset by a reset spring. The operating unit is joined with a pushing piece which is located in a housing to push on the inside of the moving unit and cause the outside of the moving unit to swing. Or it can simultaneously drive an interior moving part to move, so the various figure patterns on the interior moving part will match the through holes on the housing. Such a construction is designed to create different changing effects, adding more fun to the animated effects.

7 Claims, 7 Drawing Sheets

MULTIPLE-SHAFT PEN KIT

SUMMARY OF THE INVENTION

The subject invention relates to a type of multiple-shaft pen kit, specifically to one with additional animation and fun effects.

Conventionally, a prior art of multiple-shaft (ink cartridge) pen kit provides only a writing function with different colored ink cartridges. It has no other functions, so its applications are limited, and it is unable to create additional fun and animated effects.

The primary objective of the subject invention is to present a type of multiple-shaft pen kit, comprising mainly of a link hook joined to the top of each of the operating knobs of a multiple-shaft pen kit. The link hook pulls on an operating unit, and can be reset to its original position by a reset spring. The operating unit is joined to a pushing piece. The pushing piece is located in a housing that can push on the inside of the moving unit, so the outside of the moving unit will swing, and it can drive an interior moving part to move, so that the different figure patterns on the interior moving part match the through holes on the housing. In operating the multiple-shaft pen kit, the moving part and interior moving part will be driven to produce various configuration effects, and create such effects of waving hands, changing facial expressions, etc., to add fun to the animated effects.

To enable better understanding of the characteristics and technical contents of the subject invention, please refer to the following detailed description with drawings. However, the attached drawings are only for the purpose of reference and description, and should not be used to restrict or limit the subject invention:

Brief Description of Numerals

| | | | |
|---|---|---|---|
| 10 | multiple shaft pen kit | 11 | main body of pen kit |
| 12 | barrel | 13 | hollow chamber |
| 14 | coordinating hole | 15 | ink cartridge |
| 16 | through hole | 17 | operating knob |
| 18 | slide channel | 19 | reset spring |
| 20 | upper protrusion | 21 | lower protrusion |
| 22 | link hook | 23 | connector seat |

-continued

Brief Description of Numerals

| | | | |
|---|---|---|---|
| 24 | operating unit | 25 | link part |
| 26 | housing | 27 | semi-sphere |
| 28 | semi-sphere | 29 | fixed pin |
| 30 | moving part | 31 | pin hole |
| 32 | pushing piece | 33 | pushing part |
| 34 | reset spring | 35 | screw |
| 36 | joining part | 37 | interior moving part |
| 38 | joining hole | 39 | figure pattern |
| 40 | figure pattern | 41 | through hole |

DETAILED DESCRIPTION OF PREFERRED EMBODIMENT

Figure 1:
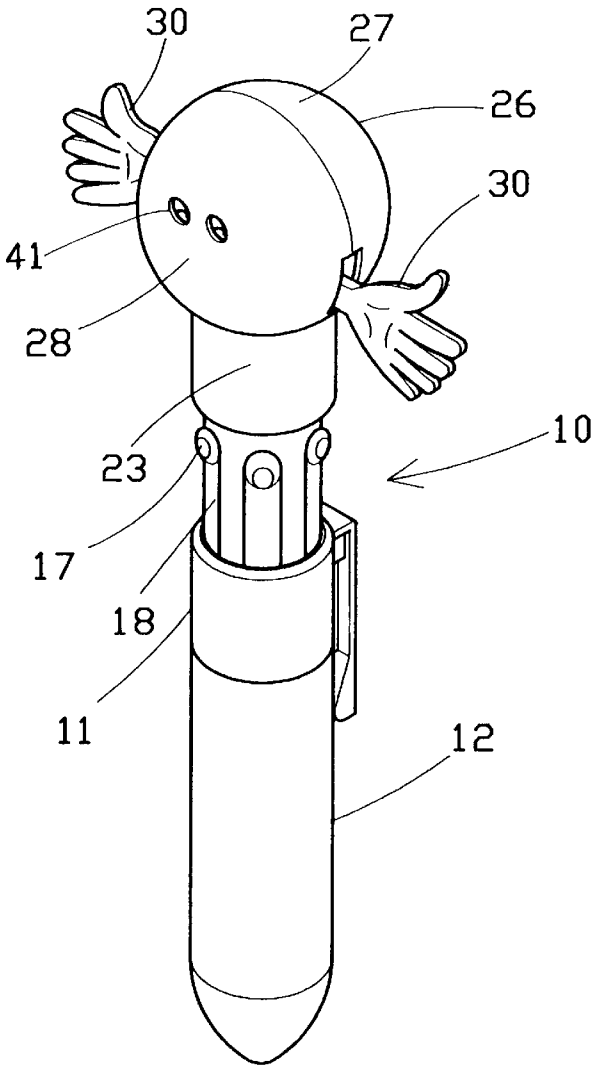
FIG. 1 is a perspective assembled view of the subject invention.
Figure 2:
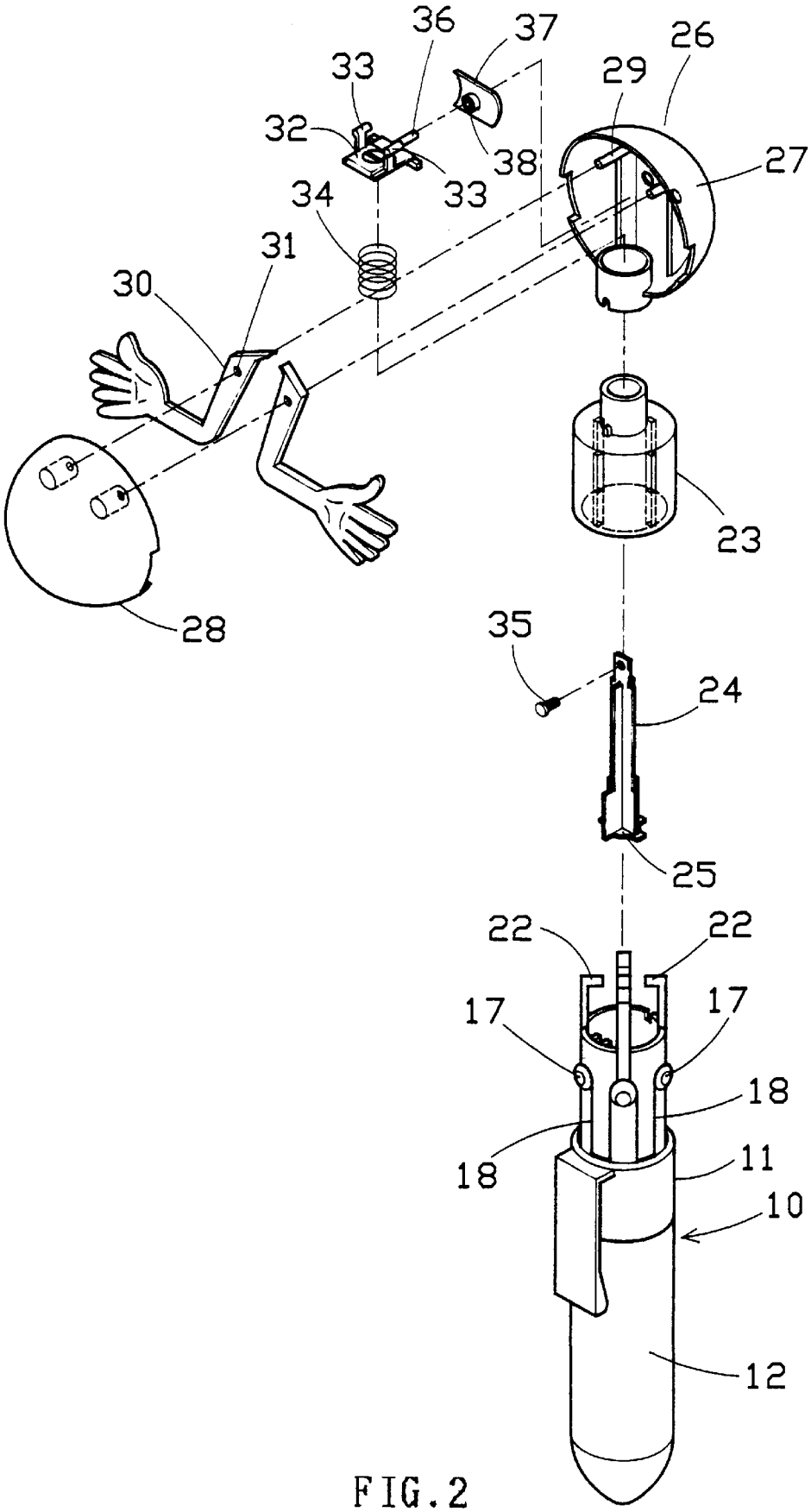
FIG. 2 is an exploded view of the subject invention.
Figure 3:
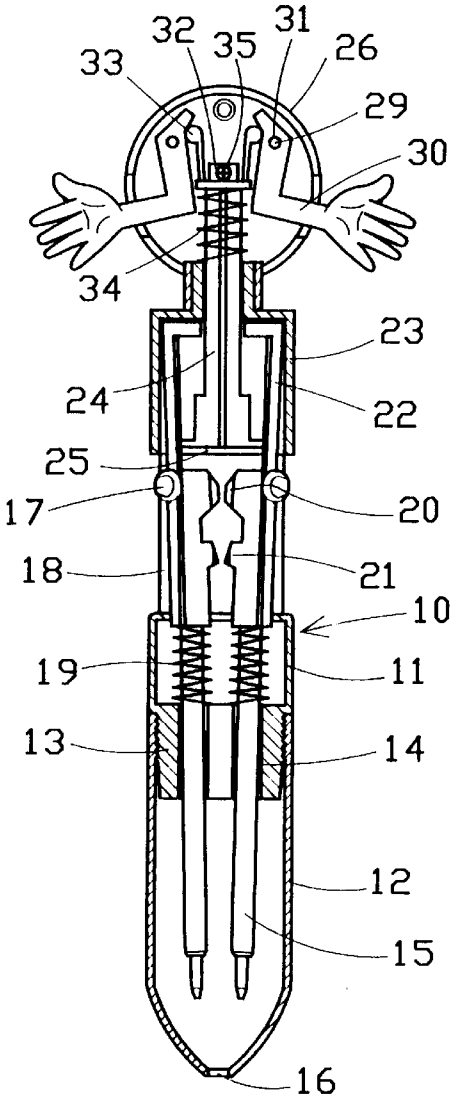
FIG. 3 is a plan sectional view of the subject invention.

Please refer to FIGS. 1, 2 and 3, a perspective assembled view, an exploded view and a plan section view of the subject invention respectively. The subject invention relates to the presentation of a multiple-shaft pen kit. The multiple-shaft pen kit (10) is comprised of the main body of the pen kit (11), the lower end of the main body of the pen kit has a barrel screwed to it (12), the main body of the pen kit (11) has a hollow chamber (13). Inside the hollow chamber (13) in longitudinal alignment are a number of round coordinating holes (14). In each coordinating hole (14) an ink cartridge has been inserted (15). The ink cartridge can contain one of many different colored inks such as red, black, blue, green, etc. At the lower end of the barrel (12) is a through hole (16) to allow for the extension of the ink cartridge (15) for writing purposes. The top end of each ink cartridge (15) has an operating knob attached (17). The operating knob (17) moves inside the slide channel (18) that is located along the longitudinal alignment on the main body of the pen kit (11). To operate the extension or retraction of the ink cartridge (15), the top of the ink cartridge (15) has been fitted with a reset spring (19) which provides the force to retract the ink cartridge (15). When the user depresses the operating knob (17) and pushes it down (forward), the ink cartridge (15) will be pushed out and when the operating knob (17) moves down and reaches a specified position, the operating knob (17) can be inserted in a fastening part (not shown in drawing) at the lower end of the slide channel (18), so that the ink cartridge (15) can be extended and fixed in position to facilitate writing. Fixed inside the operating knob (17) is an upper protrusion (20) and a lower protrusion (21), so that after the user has positioned an ink cartridge (15) through the opening (16), and then depresses a second operating knob (17) to push it down (forward), the lower protrusion (21) of the next operating knob (17) will push the upper protrusion (20) of the operating knob (17) of the ink cartridge (15) previously extended. This results in the previously extending operating knob (17) moving slightly outward to move out of the fastening part at the lower end of the slide channel (18), so that the previous operating knob (17) moves up due to the force from the reset spring (19), and cause the previous ink cartridge (15) to retract. Since the aforementioned construction of a multiple shaft pen kit (10) is similar to a prior art that is beyond the scope of the subject claim, it is unnecessary to elaborate the details.

Figure 4:
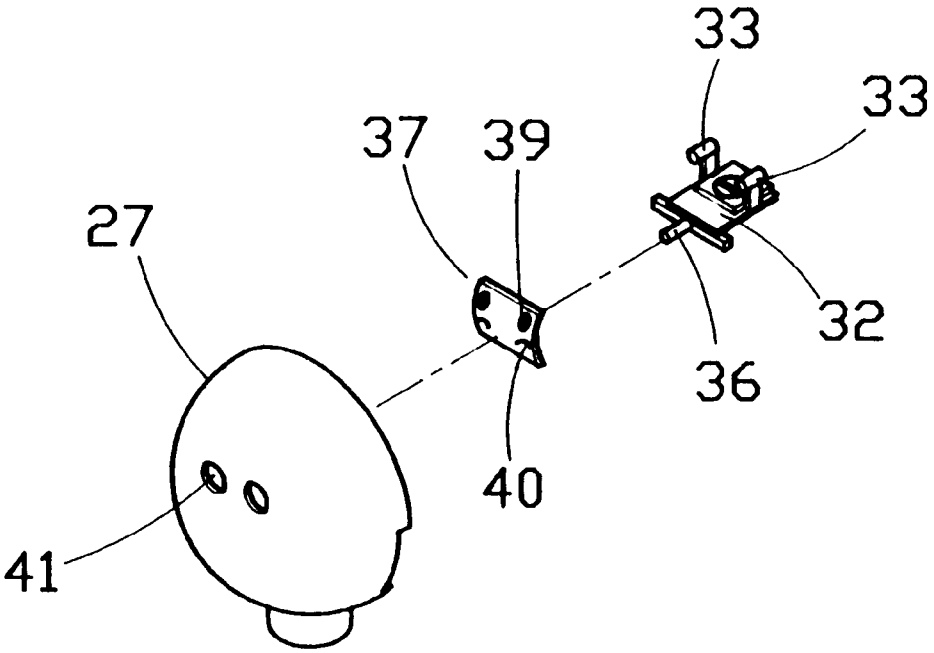
FIG. 4 is an exploded view of a part of the subject invention.

The subject invention is characterized in that, on the top of each operating knob (17) is the extension of a link hook (22). The main body of the pen kit (11) is fixed with a connector seat (23). In the connector seat (23) is a movable operating unit (24). The lower end of the operating unit (24) is a formation of a protruding link part (25) and the link hook (22) can be hooked onto the link part (25) at the lower end of the operating unit (24). Therefore, when the operating knob (17) is pushed down (forward), the operating knob (17) will move the operating unit (24) down (forward) by means of the link hook (22) that pulls on the link part (25) at the lower end of the operating unit (24). Fixed on the connector seat (23) is a housing (26). This housing can be composed of two semi-spheres (27 and 28) and inside the housing (26) are two (or no less than one) fixed pins (29). Each of the two moving parts (30) is secured via the pin hole (31) to the fixed pin (29). The outside of the moving part (30) extends out of the housing (26) and the housing (26) and the moving part (30) can be configured in various ways as required. The housing (26) in the subject embodiment is a sphere and moving part (30) is shaped as a hand figure. The top of the operating unit (24) is fastened by a screw (35) to a pushing piece (32). This pushing piece (32) is located within the housing (26). On the pushing piece (32) is a protrusion of two pushing parts (33). On top of the operating unit (24) is a reset spring (34) that provides the force for the operating unit (24) to move upward. Meanwhile, on the front of the pushing piece (32), there is a protrusion (36) extending from a front portion of the pushing piece (32) for joining a moving part (37) thereto. The interior moving part (37) has a joining hole (38) that receives the protrusion (36) to couple them as a single unit. Interior moving part (37) is joined to pushing piece (32) and interior moving part (37) is located inside the housing (26). On interior moving part (37) are a pair of eyes located at the top and bottom with different patterns (39 and 40) (as shown in FIG. 4). On the semi-sphere (27) of the housing (26) is a pair of through holes (41) shaped like eye sockets, with patterns (39 or 40) that correspond to through hole (41).

Figure 5B:
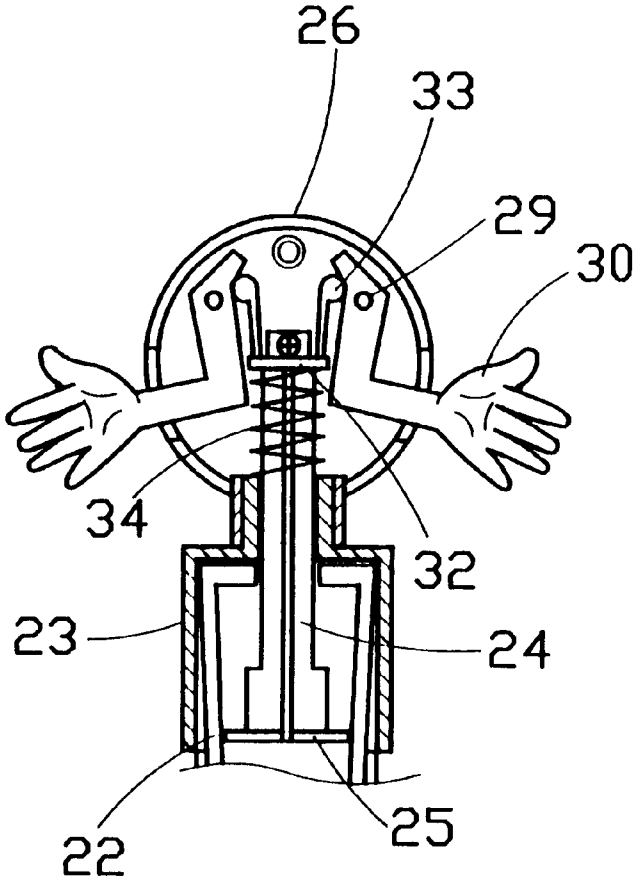
FIG. 5B is an illustration of the subject invention in action.
Figure 5A:
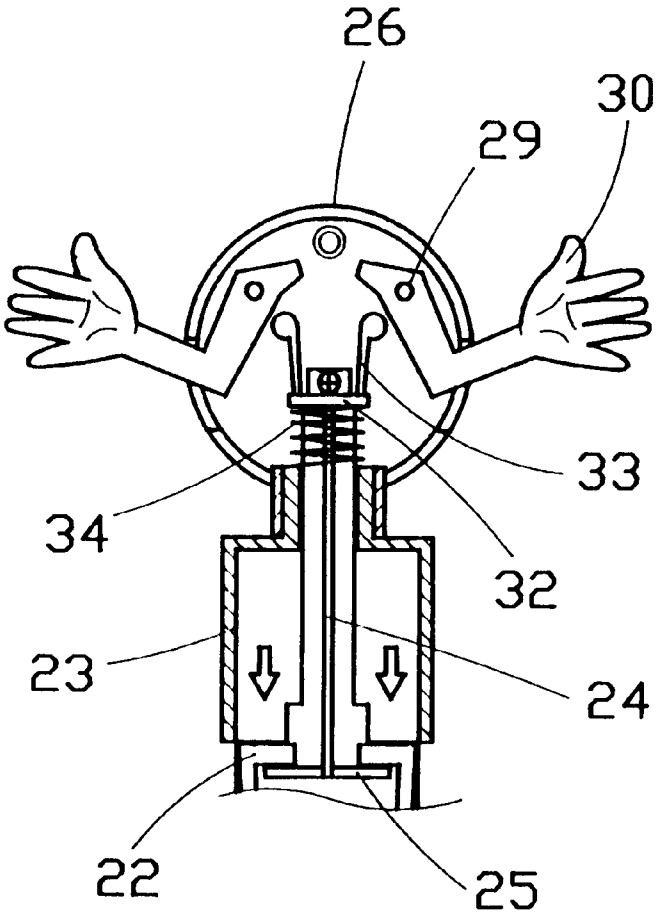
FIG. 5A is an illustration of the subject invention in action.
Figure 6B:
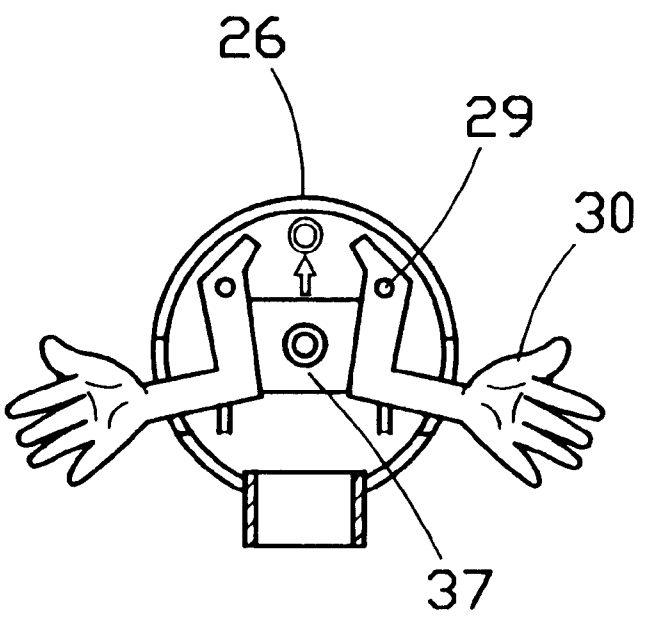
FIG. 6B is an illustration of the subject invention in action.
Figure 6A:
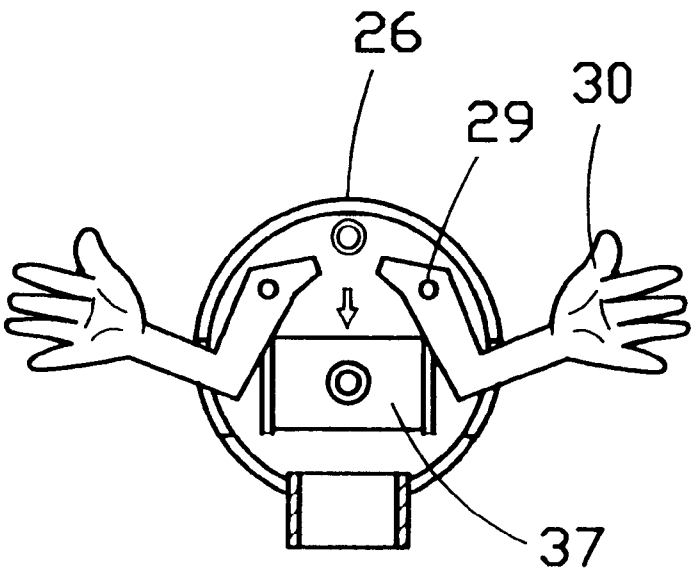
FIG. 6A is an illustration of the subject invention in action.
Figure 7B:
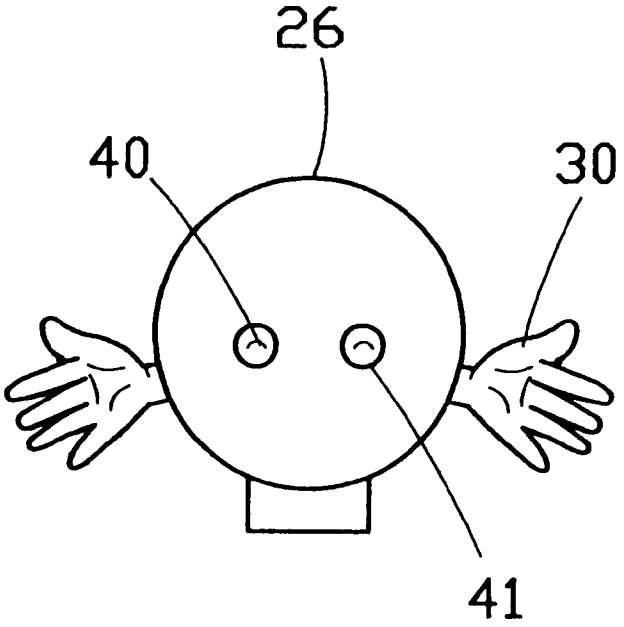
FIG. 7B is an illustration of the subject invention in action.
Figure 7A:
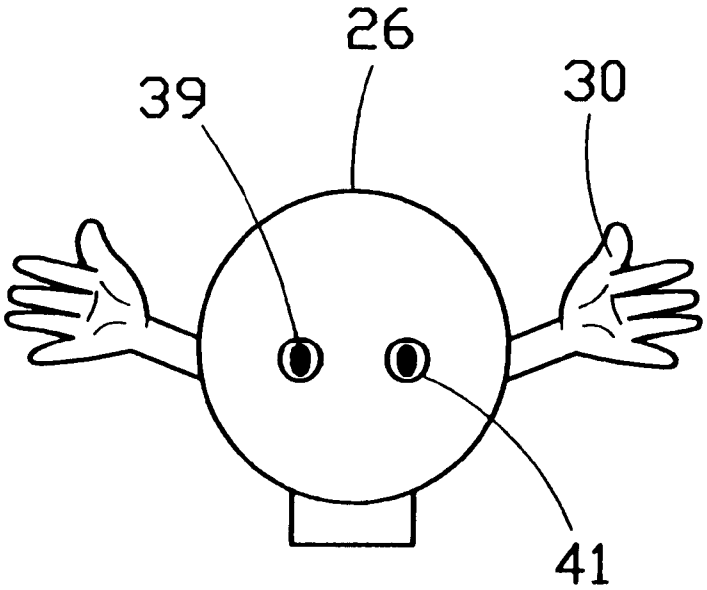
FIG. 7A is an illustration of the subject invention in action.

Please refer to FIGS. 5A, 6A and 7A. When the user depresses the operating knob (17) down (forward) to extend the ink cartridge (15), the operating knob (17) will move the operating part (24) down (forward), by means of the link hook (22) that pulls on the link part (25) at the lower end of operating part (24). Then, operating part (24) will drive the pushing piece (32) down, so the two pushing parts on pushing piece (32) push on the inside of moving parts (30). This will cause the outside of the two moving parts (30) to swing upward, and interior moving part (37) to move down. One pair of patterns (39) on the interior moving part (37) will match the through hole (41) on the housing (26); please refer to FIGS. 5B, 6B and 7B. When the user moves the operating knob (17) up (forward) to retract the ink cartridge (15), the operating knob (17) will move the link hook (22) to release the pulling force on the moving part (25) at the lower end of the operating unit (24). This will cause the operating unit (24) to move up to its original position by means of the spring (34) force, then, the operating unit (24) will drive the pushing piece (32) up, and the two pushing parts (33) on the pushing piece (32) pushes on the inside of the moving part (30), and the outside of the two moving parts (30) will swing downward. Meanwhile, this will drive the interior moving part (37) up, so the other pair of patterns (40) on the interior moving part (37) will match the through hole (41) on the housing (26). By such a special design in the subject invention, when the multiple-shaft pen kit (10) is being used, the moving part (30) and interior moving part (37) will change configuration, and with the coordination of various changing appearances of the housing (10), the moving parts (30) and the interior moving parts (37), various effects, such as waving hands, changes of facial expression. etc. can be achieved to enable better and more interesting animation effects.

It is hereby declared that the above description, covering only the preferred embodiment of the subject invention, should not be used to limit or restrict the subject claim, and that all equivalent structural and/or configuration variations and/or modifications easily conceivable to anyone skilled in the subject art, and deriving from the subject description with drawings herein shall reasonably be included in the intent of the subject claim.

I claim:

1. A multiple-shaft pen, comprising:

a tubular main body having opposing upper and lower ends, said main body having a plurality of longitudinally directed angularly spaced channels;

a tubular barrel coupled to said lower end of said main body and having a opening formed in a distal end thereof;

a plurality of ink cartridges disposed in a bore defined by said tubular main body and said tubular barrel, each of said ink cartridges having a first spring coupled thereto and an operating knob extending from a proximal end thereof and disposed in a respective one of said plurality of channels for controlling displacement of said ink cartridge into said opening against a bias force established by said first spring and withdrawal therefrom using said bias force, each said operating knob having a link hook extending therefrom for displacement with said operating knob;

a connector seat coupled to said upper end of said main body, said connector seat having a longitudinally extended through bore formed therein;

a movable operating member disposed in said through bore, said movable operating member having a lower end coupled to an upper end of each said link hook for displacement therewith;

a housing coupled to an upper end of said connector seat;

a second spring disposed on said movable operating member;

a pushing piece disposed in said housing and coupled to said movable operating member for displacement therewith, said pushing piece being biased by said second spring; and, a pair of first moving parts pivotally coupled to said housing and contacting said pushing piece for angular displacement of said pair of first moving parts responsive to said longitudinal displacement of said operating knob.

2. The multiple-shaft pen as recited in claim 1 where said housing is formed by a pair of semi-spherical housing members coupled together.

3. The multiple-shaft pen as recited in claim 1 where said housing includes fixed pins for coupling through apertures formed in said pair of moving parts.

4. The multiple-shaft pen as recited in claim 1 where each of said pair of first moving parts has a shape resembling that of a hand.

5. The multiple-shaft pen as recited in claim 1 further comprising a second moving part disposed in said housing and coupled to said pushing piece for displacement therewith, said second moving part having indicia formed thereon at least partially visible through corresponding holes formed through said housing.

6. The multiple-shaft pen as recited in claim 5 where said pushing piece includes a projecting part extending therefrom, said second moving part having a joining hole formed therein for coupling with said projecting part of said pushing piece.

7. The multiple-shaft pen as recited in claim 5 where said indicia on said second moving part includes representations of differently appearing eyes.

* * * * *